US005139182A

United States Patent [19]

Appla

[11] Patent Number: 5,139,182

[45] Date of Patent: Aug. 18, 1992

[54] CLOSURE AND DISPENSING DEVICE FOR CONTAINERS

[76] Inventor: Constandinos Appla, Suite 17/25 Martin Street, Thornbury, Victoria, 3071, Australia

[21] Appl. No.: 634,708

[22] Filed: Dec. 27, 1990

[51] Int. Cl.[5] ..... B67D 3/00

[52] U.S. Cl. ..... 222/519; 222/108; 222/547; 222/564; 222/568

[58] Field of Search ..... 222/108, 109, 514–525, 222/479, 546, 552, 568, 547, 564; 220/208, 361, 373, 374, DIG. 27, DIG. 32, DIG. 33; 215/307, 311

[56] References Cited

U.S. PATENT DOCUMENTS

| | | | |
|---|---|---|---|
| 796,256 | 8/1905 | Sanders | 222/525 X |
| 2,167,476 | 7/1939 | Diefenbach | 222/546 |
| 2,618,800 | 11/1952 | Ràab | 222/546 |
| 2,715,480 | 8/1955 | Livingstone | 222/568 |
| 2,780,391 | 2/1957 | Jasuta | 222/541 |
| 2,998,902 | 9/1961 | Thomas et al. | 222/525 |
| 3,075,676 | 1/1963 | Borah | 222/568 |
| 3,123,259 | 3/1964 | Musel et al. | 222/545 |
| 3,389,839 | 6/1968 | Williams | 222/520 |
| 4,497,422 | 2/1985 | Klees | 222/568 |
| 4,878,774 | 11/1989 | Karasin et al. | 222/524 |
| 4,927,065 | 5/1990 | Beck | 222/520 |

*Primary Examiner*—Kevin P. Shaver
*Assistant Examiner*—Philippe Derakshani
*Attorney, Agent, or Firm*—Marion P. Lelong

[57] ABSTRACT

A two-piece, plastic, screw-on, closure and dispenser has an outer tubular female part with upper and lower internal screw threads and a separate, inner tubular male part with a single external screw thread rotatably attachable to the upper thread of the female part the lower thread of which is screwed onto the external screw thread of an outlet on top of a container, the male part is double-walled, an elongated pouring spout is an integral axial extension of an inner wall and a knurled hand knob is at the top of an outer wall and is turnable in either direction within the stationary female part for axial extension or retraction of the spout. An integral, internal, annular frustro-conical flange extends around the internal wall surface of the female part between threads and forms a valve seat around a fluid-flow opening. A disc-like valve member with a frustro-conical, peripheral, valve-sealing surface is spaced by webs below the male part creating in conjunction with the valve seat, a baffled port for interrupting two way flow of air entering and liquid exiting a container via the device to smooth out liquid dispensing by reducing the size and increasing the rapidity of "glugging". Combination movement stops and sealing surfaces on external ledges are provided between male and female parts.

4 Claims, 2 Drawing Sheets

CLOSURE AND DISPENSING DEVICE FOR CONTAINERS

This invention relates generally to container closure devices and relates more particularly to a plastic screw-on closure device for dispensing liquids from containers.

BACKGROUND OF THE INVENTION

In the past, difficulty has been experienced when pouring liquids by hand from containers, especially when the containers are fairly large and full and when dealing with flammable, highly viscous and other liquids which are difficult to handle. The efflux of liquid from the container can be too sudden or irregular due to a flow interruption phenomenon known as "glugging" caused by large air bubbles entering the container at slow speeds with resultant surges in flow rate. This leads to spillage on persons, clothing or equipment.

Metallic closure caps have largely been replaced by plastic caps and particularly those of so-called "yieldable" plastics material because of greater durability and ease of manufacture by injection moulding techniques. Resilient, two-piece, screw on, captive caps of plastic material for fitment to containers for dispensing liquids thereform through a closable opening are known wherein the cap is rotated in a clockwise direction to close the discharge opening and in an anti-clockwise direction to open the discharge opening. Many captive, screw-on caps are of the snap-fit variety and are not removable from the container by a consumer without damage. Effective sealing of the surfaces of closure caps either with containers or insert members is a problem. Some rotatable, screw-valve, captive plastic caps rely on deformation and distortion of the wall of an outer sleeve or tubular member by the user during placement of a captive cap upon the container. The sleeve usually has an internal annular flange on the bottom edge which engages with an external annular flange or lip on the container neck. Examples of this type of closure are disclosed in U.S. Pat. No. 1,977,537 of Warmuth, U.S. Pat. No. 2,051,513 of Bingham and U.S. Pat. No. 2,969,896 of Lerner. In all of these patents, the whole cap is rotated and use is made of the rim of the container neck as a sealing surface. Other caps, such as those in U.S. Pat. No. 3,216,630 and U.S. Pat. No. 3,351,249 of Stull, rely on radial distortion of an upper edge of a wall of a resilient tubular sleeve member to free an annular sealing surface bead of a closure cap from an internal annular groove in the wall each time that the cap is screwed open or closed for axial movement. This type of closure can be assembled during manufacture by axial snap-fitting movement over-riding the threads instead of a rotary movement. In another closure type described in U.S. Pat. No. 3,033,428 of Van Baarn, distortion and deformation of resilient sealing members is used during closure movement to prevent sticking of sealing members due to residual amounts of material dispensed from a container with liquid to which the closure has been fitted. In another U.S. Pat. No. 3,276,640 of Kessler, distortion for fitment is achieved by having a central, resilent plug, (integral with an axially slidable cap and plunger) of double taper and with a blind bore in the bottom, the plug being forced past an internal flange on an unthreaded tubular, sleeved pouring spout. In U.S. Pat. No. 3,606,105 of Santore, a screw-on cap moves axially and uses direct sealing against the upper rim or edge of a squeeze container dispenser and dispensing relies partly on the container structure and material rather than the closure.

SUMMARY OF THE INVENTION

It is an object of this invention to provide a smoother flow-control, screw-on closure and liquid-dispensing device for containers.

Another object is to provide a leak-proof closure and liquid-dispensing device for containers.

Another object is to provide an improved, two-piece, plastic closure and liquid dispensing device which has an internal thread for fitment to containers which have an external screw thread and which can be dismantled, removed from the container and wiped clean for transfer and use on another container with different liquid contents.

In accordance with these objects and the principles of this invention, there is provided a screw-threaded, plastic closure and liquid dispensing device for fitment to containers with an external screw threaded outlet. The device comprises: a female outer tubular member and a male inner tubular member, the female member having two axially spaced internal, molded-in threads, one thread being a lower or inner thread, the other being an upper or outer thread. The lower thread is attachable to a container by screwing onto a threaded container outlet. The male member has a single external thread and is rotatably attachable to the female member by screwing the male external thread into the outer or upper internal female thread.

An internal annular valve seat is carried within the female member and an annular valve liquid-sealing surface is carried by the male member which is hand-rotated in one angular direction to extend it to open the valve and is rotated in the opposite direction to retract it and close the valve. A large bore, air-ingress and liquid-egress port is provided between the members when the valve is in the open position with the male inner member in an axially extended position with respect to the female outer member. There is a combination valve aperture and baffle structure incorporated within the valve assembly, and the configuration, spacing and positioning of the valve baffle and aperture in relation to the valve seat and valve seating surfaces are designed to create non-linear flow and improved mixing of incoming air and discharge of liquid to provide a smoother two-way flow of fluids through the valve, resulting in reduction of the low frequency, high-amplitude discharge flow interruption phenomenon known as "glugging", by reducing the amplitude and increasing the frequency of flow of the disturbance.

The male member has a double wall, an inner wall extends out beyond an outer wall to form a pouring spout, the top of the outer wall has a knurled hand knob on it and any liquid pouring or dripping down the outside of the top of the spout runs into the gap between the walls and is prevented from coming into contact with hands or fingers of a user. Also for this purpose the rim of the spout is formed into a bevelled flow cut-off edge. The projecting spout can be wiped clean after use. Further advantageous features comprise combination fluid seals and movement stops between co-operating external edge surfaces on ledges formed on peripheral intermediate stepped portions between the assembled members. These edges and surfaces are formed as an integral part of the closure.

The novel arrangement of features which are considered to characterize the invention are set forth in particular in the appended claims.

Other features, uses and advantages of the invention will become apparent from a reading of the following description of the embodiment thereof presented in the accompanying drawings.

BRIEF DESCRIPTION OF THE DRAWINGS

A non-limitative example of a preferred embodiment of the closure and liquid-dispensing device for containers according to the invention will be described in greater detail by reference to the accompanying drawings in which like reference numbers denote corresponding parts and in which.

DESCRIPTION OF THE ILLUSTRATED EMBODIMENT

Figure 1:
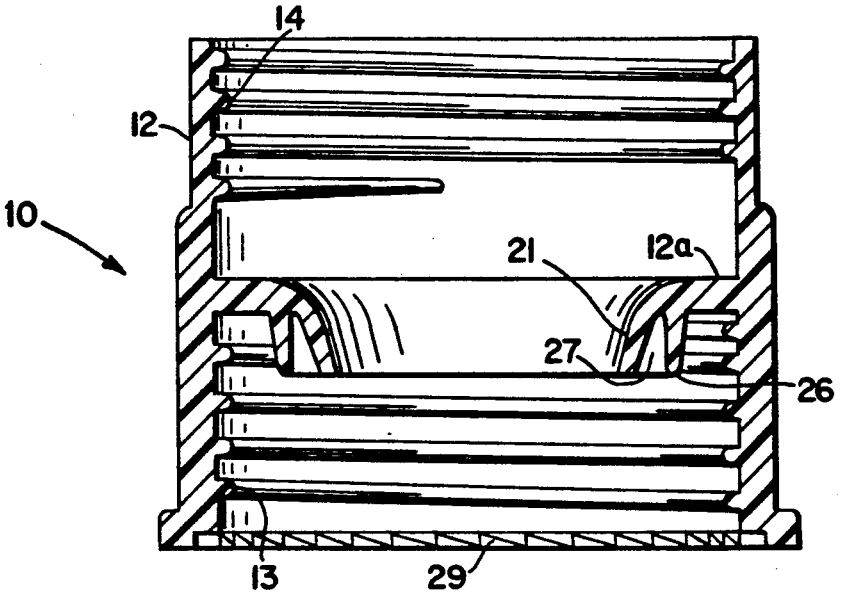
FIG. 1 is a sectional elevational view of the separated, outer first tubular member according to the invention prior to assembly into the device.
Figure 2:
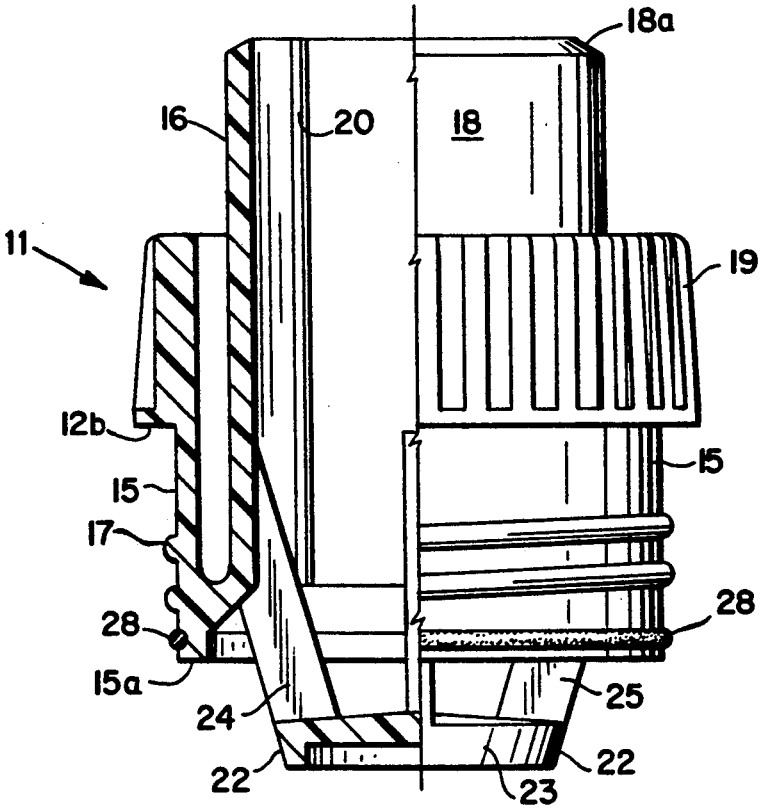
FIG. 2 is a part-sectional elevational view of the separated inner, second member of the closure and dispenser device according to the invention.

Reference is now made to the drawings in which FIGS. 1 and 2 show for clarity the two separate, screw-threaded male and female plastic components of the two-piece dispenser and closure for containers with an external screw thread and prior to assembly. Referring to FIG. 1, there is shown a single-walled, female first member 10 of tubular configuration into which a male second member 11 is adapted to be releasably socketed. The male second member 11 is also tubular in configuration but is double-walled. Both members are preferably made by injection molding from a yieldable synthetic polymeric material or materials such as polyethylene or polypropylene. The components can both be made of the same material or from different polymeric materials or from different grades of the same polymeric material to provide improved sealing, better-wearing and rotational properties.

The female tubular member 10 has a single wall 12, the lower portion (or inner portion with respect to a container) of which is provided with a lower internal thread 13 for screwing the member 10 onto an external thread of a neck of container for liquids (not shown). The upper portion of the wall 12 (or outer portion with respect to dispensing outlet of the device) of the female outer tubular member 10 is also provided with an internal thread 14. The male inner member 11 has a radially outer wall 15 and a mainly cylindrical radially inner wall 16. The outer wall 15 is provided with an external, moulded-in thread 17 corresponding to the upper or outer internal thread 14 of the female member and into which the male member is adapted to be rotated clockwise during assembly and rotated in either direction for axial extension or retraction, respectively, of the male member with respect to the female member after the female member has been screwed onto the threaded neck of a container.

Figure 3:
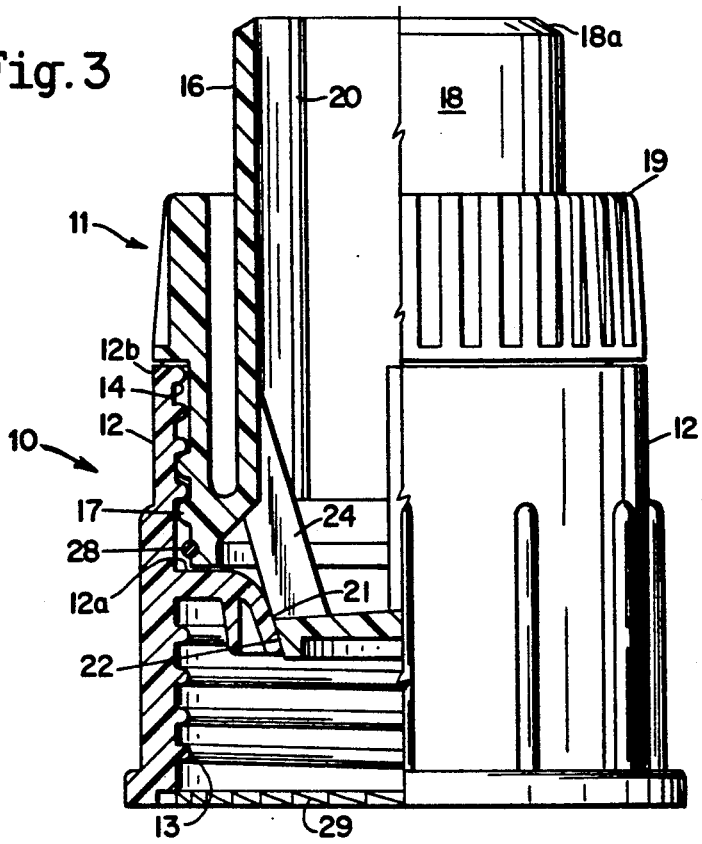
FIG. 3 is a half sectional elevation of components of FIGS. 1 and 2 assembled into the closure and dispenser device according to the invention with the valve in closed, non-dispensing, position.
Figure 4:
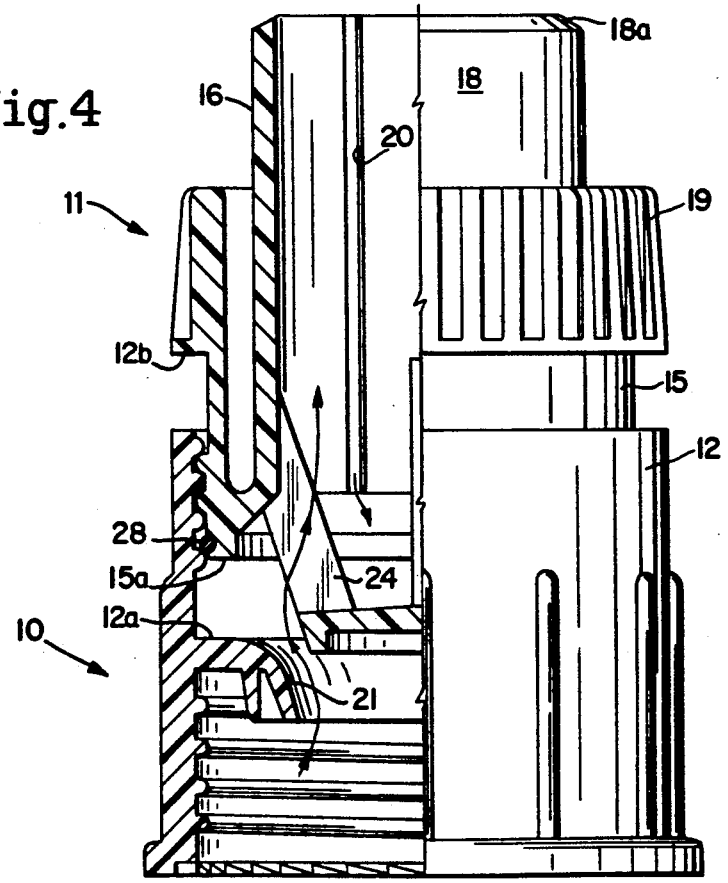
FIG. 4 is a similar view to FIG. 3 but with the valve in open, liquid-dispensing position.

The assembled combination closure and dispenser device is shown in FIGS. 3 and 4 and is in the valve-closed position in FIG. 3 and valve-open position in FIG. 4. Integrally molded combination motion stops and liquid seals are provided by co-operating annular engaging surfaces formed on both male and female members, specifically on the underside edge 12*b* of the knurled hand knob 19, the top of the wall 12 of the female member 10, the bottom edge 15*a* of the outer wall 15 of the male member 11 and an annular ledge 12*a* on the inner surface of the female member 10 to seal off screw threads of the members 10, 11 and to prevent damage to valve seat and valve-sealing surfaces (as hereinafter described) when the members are screwed tight into a valve-closed position.

The male member 11 has a portion of the inner wall thereof formed into an integral pouring spout 18 which has a sharp chamferred edge 18*a* formed thereon to cut off liquid flow when a container with the device attached is tilted into an upright position after pouring and dispensing is finished. The male member 11 has a knurled, hand-operable, valve-turning knob 19 integrally molded around the top of the outer wall 15, the knob providing a supporting shoulder upon which the device may be tilted when screw-connected to the threaded neck around the opening of a container. If desired, the internal surface of the inner wall 16 of the male member 11 may be provided with a plurality of longitudinal, supplementary air bleed or breather slots such as the one shown at 20 which provide supplemental air venting into a container to which the device of the invention has been attached and during egress of liquids from the container to promote smoother liquid flow therefrom and smoother air flow into the container.

The lower portion of the female member 10 has integrally formed therein a valve seat 21 in the form of an internal, downwardly curved, annular flange and, projecting from the bottom of the male member 11 there is an integrally-formed, disc-like plug which has a valve-sealing surface 22 formed around the peripheral edge thereof. The valve sealing surface is preferably frustroconical in shape and is complementary in shape to the surface of the valve seat 21 of the female member.

The male and female members are assembled by screwing the male member into the upper or outer portion of female member 12 to form a valve assembly incorporating the integrally molded-in valve seat of the female member and the molded-in valve-sealing surface of the male member. Both inner and outer walls of the male member 11 are joined adjacent the bottom thereof and a circular valve disc 23 with the previously-mentioned valve-sealing surface 22 depends from and projects below the bottom edge of the inner wall and is joined to the inner surface of it by means of four longitudinal, radially disposed, tapered webs forming ribs such as the two 24 and 25 shown in FIG. 2. These webs project axially beyond or below the lower edge of male member 11, and a port is formed by the fluid flow gaps between the webs and the lower edges of the walls and the edge of the circular valve disc 23 for passage of fluid, that is to say two-way flow of air ingress and liquid egress.

The effect which is created by this design is air-liquid mixing or deflecting baffles for a more regulated fluid flow therethrough when the valve is turned into the open, liquid-dispensing position, with the male member axially extended with respect to the female member by rotation of the male member in an anti-clockwise direction. The net hydrodynamic effect is to break up the large amplitude, low frequency, fluid-flow disturbance phenomenon known as "glugging" by promoting a lower amplitude, higher frequency of such disturbances into a smoothing out by smoother fluid flow.

There is also integrally formed behind or below the valve seat 21 at the base of the female member 10 of the device, a sealing lip 26, a gap 27 being formed between the lip 26 and the bottom surface underneath the valve seat 21 to allow yieldability to permit the seat 21 to maintain a correct co-axial sealing contact relationship with the sealing surface 22 of the valve plug disc integrally formed with the male member 11 for correct sealing contact of the valve surfaces irrespective of any molding irregularity which may arise during manufacture of the device or which may be present in the container outlet.

An O-ring wiper seal member 28 is preferably provided on the lower perimeter of the outer wall of the male inner member 11 of the device according to the invention. Around the inside of the bottom edge of the female outer member, there is preferably provided a plurality of ramped notches or teeth such as the one labelled 29 for engagement with a threaded boss of a plastic container or a drum or tin to prevent slippage of the female outer member 10 when in place upon a container or the like.

Variations and modifications of the invention may be made within the scope of the claims and parts or portions of the container closure and dispensing device may be used without others and it will therefor be understood that the embodiment described above is in no way restrictive and may give rise to any desirable modification without departing from the scope of the invention.

I claim:

1. A screw-threaded, plastic closure and liquid-dispensing device for containers with an externally-threaded outlet, said device comprising: a female outer tubular member and a male inner tubular member, said female member having longitudinally spaced lower and upper internally threaded portions, the lower internally screw threaded portion being attachable to the externally-threaded outlet of said container, said male member having a single external screw thread complementary to the upper internal thread of the female portion and being rotatably mountable within said female member, an internal valve seat carried by said female member, a valve liquid-sealing surface carried by said male member, whereby hand rotation of said male member in one angular direction axially extends said male member with respect to said female member to move said valve liquid-sealing surface away from said valve seat to open said device and rotation in the opposite direction retracts said male member and closes said device, an air-inlet and liquid-outlet port being provided between both said members during relative axial displacement of said members, said male member having associated flow baffle means thereon adjacent said port for non-linear air/liquid flow through said device when said device is in open position, wherein said port is partly formed by an integral, radially apertured disc projecting axially from an inner container-facing end of said male member, and wherein said male member has a tubular inner wall and a tubular outer wall and said valve-sealing surface is axially spaced from said inner tubular wall and is formed by the peripheral edge of said radially extending disc joined to and supported by integral axial baffles having an upper terminal end joined to the inside of said inner tubular wall and a lower terminal end joined to said disc, said ribbed baffles in association with said disc defining apertures for two-way fluid flow of air inflow and liquid outflow therethrough when said device is in open position and for changing the direction of fluid flow therethrough by interruption to reduce the amplitude and to increase the frequency of fluid flow interruption by "glugging" to smooth out liquid outflow from a container containing liquid and to which said device is fitted.

2. A screw-threaded, plastic closure and liquid-dispensing device for containers with an externally-threaded outlet, said device comprising: a female outer tubular member and a male inner tubular member, said female member having longitudinally spaced lower and upper internally threaded portions, the lower internally screw threaded portion being attachable to the externally-threaded outlet of said container, said male member having a single external screw thread complementary to the upper internal thread of the female portion and being rotatably mountable within said female member, an internal valve seat carried by said female member, a valve liquid-sealing surface carried by said male member, whereby hand rotation of said male member in one angular direction axially extends said male member with respect to said female member to move said valve liquid-sealing surface away from said valve seat to open said device and rotation in the opposite direction retracts said male member and closes said device, an air-inlet and liquid-outlet port being provided between both said members during relative axial displacement of said members, said members having associated flow baffle means thereon adjacent said port for non-linear air/liquid flow through said device when said device is in open position, wherein said female member has a single tubular wall with an inside surface, said valve seat being an annular, internal flange formed integrally with said wall inside surface between said lower and said upper internally-threaded portions, said flange providing part of said associated flow baffle means adjacent said port, and wherein an integral annular sealing lip is formed below said valve seat and extending from the bottom surface thereof, there being an annular gap formed between said lip and the bottom surface of said seat to allow yieldability permitting said valve seat to maintain correct sealing engagement with said valve liquid-sealing surface regardless of moulding irregularity of a plastic container neck.

3. A screw-threaded, plastic closure and liquid-dispensing device for a container having an externally threaded outlet, said device comprising: a female member having longitudinally spaced lower and upper internally threaded portions, the lower internally screw-threaded portion being attachable to the externally threaded outlet of said container, said male member having a single external screw thread complementary to the upper internally screw-threaded portion and being rotatably mountable within said female member, an internal valve seat moulded integrally with said female member, a valve liquid-sealing surface molded integrally with said male member and in direct sealing contact with said valve seat, whereby hand rotation of said male member in one angular direction axially extends said male member with respect to said female member to move said valve liquid-sealing surface away from said valve seat, thereby opening said valve, and rotation in the opposite direction retracts said male member with respect to said female member to move said valve liquid-sealing surface toward said valve seat, thereby closing said valve, a common air-vent inlet and liquid outlet port being provided between both said members during relative axial, valve-opening displacement of said members, said male member having integral flow baffle means thereon adjacent said port for non-linear, two-way air/liquid flow through said valve and to break up large air bubbles forming in said valve, wherein said male member has a tubular inner wall and a tubular outer wall and the valve-sealing surface is axially spaced from said tubular inner wall and is formed by the peripheral edge of a radially-extending disc joined to and supported by integral axial baffles having an upper terminal end joined to the inside of the inner tubular wall and an inner terminal lower end joined to said valve disc, said baffles in association with said disc defining apertures for a two-way fluid flow port for the air vent inlet and the liquid outlet when said valve is moved axially into an open position and for changing the direction of fluid flow to break up large slow moving bubbles into smaller bubbles and to smooth out the air flow into and the liquid flow out of a container while pouring from said container to which said device is fitted.

4. A screw-threaded, plastic closure and liquid-dispensing device for a container having an externally threaded outlet, said device comprising: a female member having longitudinally spaced lower and upper internally threaded portions, the lower internally screw-threaded portion being attachable to the externally threaded outlet of said container, said male member having a single external screw thread complementary to the upper internally screw-threaded portion and being rotatably mounted within said female member, an internal valve seat molded integrally with said female member, a valve liquid-sealing surface molded integrally with said male member and in direct sealing contact with said valve seat, whereby hand rotation of said male member in one angular direction axially extends said male member with respect to said female member to move said valve liquid-sealing surface away from said valve seat, thereby opening said valve, and rotation in the opposite direction retracts said male member with respect to said female member to move said valve liquid-sealing surface toward said valve seat, thereby closing said valve, a common air-vent inlet and liquid outlet port being provided between both said members during relative axial, valve-opening displacement of said members, said male member having integral flow baffle means thereon adjacent said port for non-linear, two-way air/liquid flow through said valve and to break up large air bubbles forming in said valve, wherein said female member has a tubular wall with an inside surface, said valve seat being an annular, internal, downwardly curved flange formed integrally with and projecting radially inwards from said wall surface at an axial position between said inner and said outer internally threaded portions, said flange providing part of said associated flow baffle means adjacent said port, and wherein an integral annular sealing lip is formed below said valve seat and extends from the bottom surface thereof, there being an annular gap formed between said lip and the bottom surface of said seat to allow yieldability, thereby permitting said valve seat to maintain correct sealing engagement with said valve sealing surface regardless of molding irregularity of a plastic container neck.

* * * * *